United States Patent [19]

Manten

[11] 4,346,766

[45] Aug. 31, 1982

[54] DRILL CRADLE WITH ELONGATED SLIDE TRACK

[75] Inventor: Heinrich Manten, Salzgitter, Fed. Rep. of Germany

[73] Assignee: Salzgitter Maschinen und Anlagen Aktiengesellschaft, Salzgitter, Fed. Rep. of Germany

[21] Appl. No.: 133,121

[22] Filed: Mar. 24, 1980

[30] Foreign Application Priority Data

Apr. 4, 1979 [DE] Fed. Rep. of Germany ..... 2913438

[51] Int. Cl.[3] ..... E21B 7/02; E21B 15/04

[52] U.S. Cl. ..... 173/23; 173/43; 173/28

[58] Field of Search ..... 173/23, 28, 42, 43, 173/22

[56] References Cited

U.S. PATENT DOCUMENTS

| | | | |
|---|---|---|---|
| 2,711,305 | 6/1955 | Henkel | 173/43 |
| 2,980,372 | 4/1961 | O'Leary | 173/43 X |
| 3,225,842 | 12/1965 | Roeschen | 173/43 X |
| 3,244,240 | 4/1966 | Ragnarsson | 173/43 |
| 3,612,190 | 10/1971 | Wills | 173/43 X |
| 3,702,162 | 11/1972 | Gronfors | 173/43 |
| 3,823,902 | 7/1974 | Bumueller | 173/43 X |
| 4,067,398 | 1/1978 | Franzen et al. | 173/43 |
| 4,158,520 | 6/1979 | Prebensen | 173/43 X |

FOREIGN PATENT DOCUMENTS

| | | | |
|---|---|---|---|
| 1484567 | 9/1969 | Fed. Rep. of Germany | 173/22 |
| 509713 | 6/1976 | U.S.S.R. | 173/43 |

*Primary Examiner*—Wm. Carter Reynolds
*Attorney, Agent, or Firm*—Michael J. Striker

[57] ABSTRACT

A drill cradle comprises a carriage, an elongated slide track carried by said carriage substantially parallel to the sole of the mine gallery in which the drill cradle may be used, and at least one slide supported on said slide track movable in longitudinal direction of the latter. An elongated rail is mounted movably in longitudinal direction and tiltable about an axis on the slide. A boring bar and a drive are mounted on the rail, and at least one side member is hingedly connected to one end of the slide track, movable between a first position in which the side member forms a longitudinal extension of the slide track so that the slide may also move along the extension and a second position upwardly or downwardly extending from the slide track so as to facilitate moving of the drill cradle through a narrow underground mining gallery.

9 Claims, 9 Drawing Figures

DRILL CRADLE WITH ELONGATED SLIDE TRACK

BACKGROUND OF THE INVENTION

The present invention relates to a drill cradle carrying an elongated slide track extending at least substantially parallel to the sole of a mine gallery on which the drill cradle moves and on which at least one slide is guided on the slide track for movement in longitudinal direction therealong. Each slide carries an elongated rail movable in longitudinal direction and turnable about an axis and the rail carries a boring bar and a drive therefor and eventually also an anchor setting device.

A known drill cradle of the aforementioned kind is the anchoring, boring and setting cradle ABS 6.8/1400R of the company Schmidt, Kranz and Co. GmbH, Federal Republic of Germany, which in the magazine "Glueckauf," 1978, page 1088 is illustrated and described. The slide track in the known drill cradle is arranged transverse to the direction of movement thereof and about as long as the width of the carriage. The range of application of this known drill cradle is rather limited, due to the relatively short length of the slide track.

SUMMARY OF THE INVENTION

It is the object of the present invention to considerably increase the range of application for a drill cradle, especially for stope boring, anchor hole boring and setting of anchors and to increase the output of the drill cradle.

With these and other objects in view, which will become apparent as the description proceeds, the drill cradle according to the present invention mainly comprises carriage means, an elongated slide track carried by the carriage means substantially parallel to the sole of the mine gallery in which the drill cradle is used, at least one slide supported on the slide track movable therealong, an elongated rail mounted movable in axial direction and turnable about an axis on the slide, a boring bar and a drive therefor mounted on the rail, and a least one side member connected to one end of the slide track for extending the latter in longitudinal direction.

In this way the at least one slide and the elements carried thereby may move beyond the carriage on the slide track and the at least one side member and be brought in operating position. Thus, relatively large cross-sections may be operated on with a single base position of the drill cradle. In this way it is possible to considerably increase the output and the precision of the boring operation, even over relatively large cross-sections. The at least one side member may be removed quickly and simply from the slide track, when the bore cradle is to be used in an underground gallery of relatively narrow cross-sections.

The at least one side member has, at least in the guide region of the at least one slide, the same cross-section as the slide track. This permits a quick and substantially trouble free movement of the slide from the slide track onto the side member and from the latter back to the slide track.

According to a preferred construction each side member is pivotally mounted to a corresponding end of the slide track and the position of the side member relative to the slide track is adjustable by a cylinder and piston unit pivotally connected at opposite ends to the slide track and the respective side member. The at least one side member can in this way be brought quickly and simply in any desired position relative to the slide track, whereby the region of application of the drill cradle is increased.

In one modification according to the present invention a supporting cylinder and piston unit is pivotally connected at one end to the free end of each side member abutting, when the respective side member forms an extension of the side track, with its other end against the sole of the mine gallery. In this construction means, preferably in the form of a fluid operated cylinder and piston unit, are pivotally connected at opposite ends to the respective slide member and to supporting cylinder and piston unit connected thereto for changing the position of the supporting cylinder and piston unit relative to the respective side member. This construction increases also the range of application of the drill cradle. Furthermore, due to the supporting cylinder it is possible, especially if the slide is placed outside the outer contour of the carriage, to operate with relative large pressure forces on the rail. This holds true especially during boring in upper direction and during setting of an anchor, since the then produced reaction forces are transmitted to the sole of the mine gallery directly over the slide track, respectively by the at least one side member and the supporting cylinder connected thereto. Due to the wide supporting basis thus derived, the total of the drill cradle obtains a very secure position, whereby the precision of the boring operation and setting of anchors is considerably increased. These advantageous results are maintained when a plurality of slides and the elements mounted thereon are arranged on the slide track and/or the at least side member.

According to another modification of the present invention, the slide track and the at least one side member connected thereto are tiltable by at least one cylinder and piston unit pivotally connected at opposite ends to the slide track and the carriage means about an axis extending parallel to the longitudinal axis of the slide track. The tilting angle is dimensioned in such a manner that the rail may, if necessary, be brought in a horizontal position so that the drill cradle may pass through an underground mine gallery of relatively low cross-section. For such tilting it is possible to bring the at least one side member into any desired position relative to the slide track.

According to a further feature of the present invention, the longitudinal axes of the slide track and the at least one side member in the operating position of the latter extends parallel to the direction of movement to the drill cradle. These longitudinal axes may however also be arranged transverse to the direction of movement or in any suitable intermediate position.

According to one modification of the present invention, each slide encompasses the slide track and/or the at least one side member only about a portion of the circumference, whereby a drive element is connected to the free portion of the slide track and the at least one side member into which a drive mounted on the slide is engaged so as to move the slide in longitudinal direction of the slide track and the at least one side member connected thereto. The drive element may be protected from outer influences and be constructed for instance as a rack or as a chain.

According to a further feature of the present invention, means are provided for turning the rail about an axis and these turning means are carried by the slide tiltable about an axis extending parallel to the longitudinal direction of the slide track and this arrangement includes also a fluid operated cylinder and piston unit pivotally connected at opposite ends to the slide and the turning means for turning the latter relative to the slide track about a tilting angle, which may for instance be 100°. In this way the rail may be brought quickly and simply in the desired operating position.

The aforementioned turning means has a drive shaft operationally connected to the rail for carrying the latter and extending at an angle of 90° to the tilting axis of the turning means for turning the rail through an angle of 360°.

In this construction an advancing cylinder, extending normal to the aforementioned drive shaft of the turning means, may be provided with the piston rod of the advancing cylinder pivotally connected to the rail. This construction preferably includes also two guide members carried by the advancing cylinder, spaced in longitudinal direction thereof, and engaging the rail for guiding the latter for movement in longitudinal direction. This will result in a properly functioning, only limited space requiring construction.

The guide members may be carried by the advancing cylinder tiltable about the axis thereof and such tilting may for instance be produced by a cylinder and piston unit pivotally connected at opposite ends to the advancing cylinder and one of the guide members.

According to a further embodiment of the present invention the slide track and the at least one side member are arranged beside the carriage as closely as possible to the sole of the mine gallery. This is especially desirable when during stope boring an especially good stabilizing of the rail, without bracing of the latter with respect to the sole of the mine gallery, should be obtained. Additional bracing means are to be avoided so that the selected inclination of the rail will not be changed during any bracing. Due to the relatively low arrangement of the slide and therewith guiding of the rail it is possible to absorb any transverse forces resulting during the boring operation without any undesired change of the inclination of the rail.

Especially in such a construction, in which the slide track is not pivotably mounted on the carriage means, it is advantageous according to the present invention when the at least one side member is tiltable in upward direction relative to the slide track from the position of the side member in which it forms an extension of the slide track.

Any suitable cross-section may be chosen for the slide track and the at least one side member. These cross-sections may be essentially quadrangular or essentially rectangular, or the I-shape.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
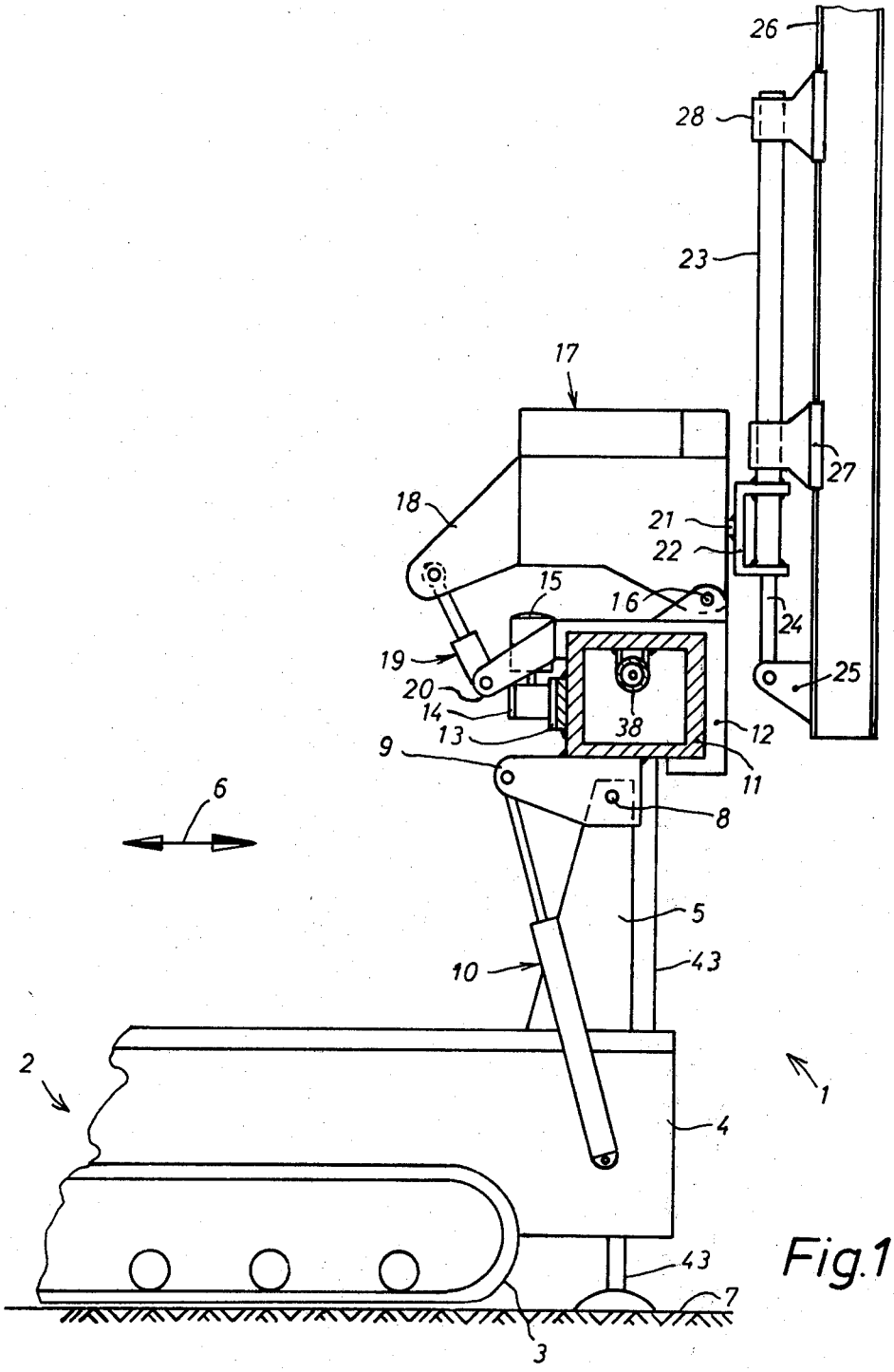
FIG. 1 is a side view of the drill cradle, partially sectioned according to the line I—I in FIG. 3.

Referring now to the drawing, and more specifically to FIG. 1, it will be seen that the drill cradle according to the present invention mainly comprises carriage means including a chassis 2 and a caterpillar drive 3 for moving the drill cradle in a predetermined direction along the sole of a mine gallery. Of course, the caterpillar drive 3 shown in FIG. 1 could also be replaced by wheels. The chassis 2 comprises a base frame 4, from the front end of which an upright mounting member 5 projects. The upper end of the mounting member 5 carries an axle 8, extending transverse to the moving direction 6 of the carriage means, on which a pair of conversely spaced brackets 9 are tiltably mounted. The opposite ends of a fluid operated cylinder and piston unit 10 are respectively pivotally connected to the outer ends of the brackets 9 and to the base frame 4. An elongated slide track 11 is welded to the upper surfaces of the brackets 9 and the circumference of the slide track 11 is partly encompassed by slide 12, movable in longitudinal direction of the slide track. A drive element 13, in form of a rack, is welded to the free surface portion of the slide track 11 and a pinion 14, driven by a motor 15 mounted on the slide 12, meshes with the rack 13 to move the slide during operation of the motor 15 along the slide track 11.

A rotary drive 17 is pivotally connected to an axle 16 carried by the slide 12 and extending parallel to the longitudinal direction of the slide track 11. An additional fluid operated piston and cylinder unit 19 is pivotally connected at opposite ends to a rearward extension 18 of the rotary drive 17 and to a similar rearward extension 20 of the slide 12 for tilting the rotary drive 17 about the axle 16.

A fork 22 is fixedly connected to the drive shaft 21 of the rotary drive 17 and a fluid operated advancing cylinder 23, extending normal to the drive shaft 21, is welded to the fork 22. The piston rod 24 of the advancing cylinder 23 is pivotally connected at its lower end to a bracket 25 fixedly connected to an elongated rail 26 extending parallel to the advancing cylinder 23. A pair of guide members 27 and 28 guiding the rail 26 for movement in longitudinal direction are turnably mounted on the advancing cylinder 23 so that the guide members together with the rail 26 may be turned about the axis of the advancing cylinder 23 by not illustrated means, for instance a cylinder and piston unit pivotally connected at opposite ends respectively to the guide member 27 and the fork 22. By feeding pressure fluid into the double acting advancing cylinder 23, the piston rod 24 is extended or retracted to therewith move the rail 26 in the desired direction relative to the guide members 27 and 28.

Figure 2:
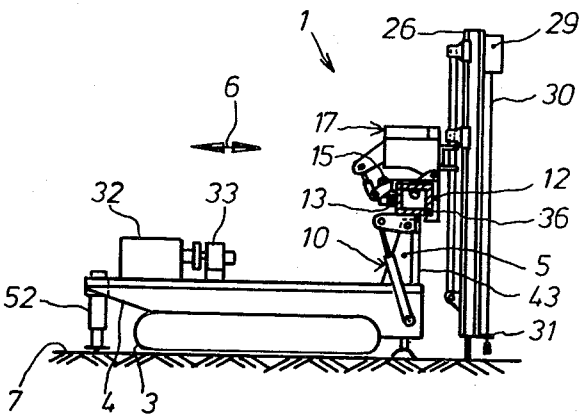
FIG. 2 is a side view drawn at a smaller scale than FIG. 1 of the drill cradle, partially sectioned according to the line II—II in FIG. 3.
Figure 5:
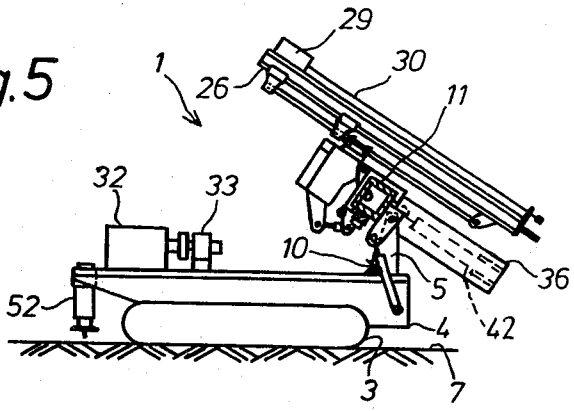
FIG. 5 is a side view of the drill cradle shown in advancing position with a rearwardly tilted rail.

According to FIG. 2, a boring bar 30 with a boring drive 29, guided by a boring bar guide 31, are movable by not illustrated means along the rail 26. An anchor setting device, likewise movable in longitudinal direction on the rail is not illustrated in the drawing, in order not to crowd the same. The base frame 4 carries on its upper surface a pump 33 for hydraulic fluid, driven by a motor 32, to supply the various cylinder and piston units with pressure fluids.

Figure 3:
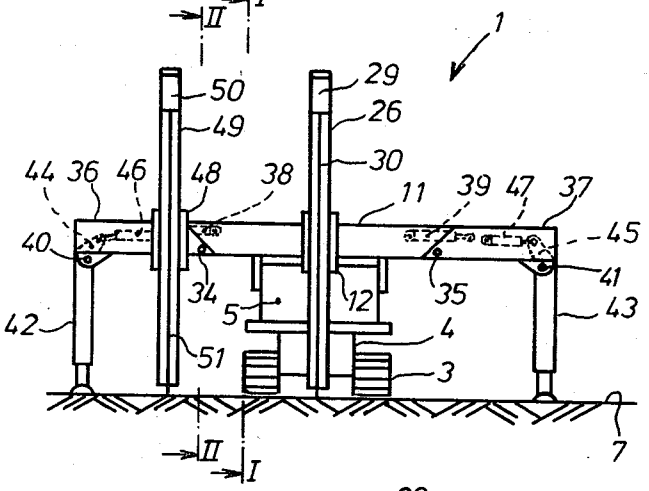
FIG. 3 is a front view of the drill cradle.

As shown in FIG. 3, a pair of side members 36 and 37 are connected respectively to opposite ends of the slide track 11, tiltable about axes 34 and 35 extending normal to the slide track. The side members 36 and 37 have the same cross-section as the slide track 11 and the angular position of the side members relative to the slide track 11 is adjustable by a pair of cylinder and piston units 38 and 39 respectively tiltable connected at opposite ends to opposite end portions of the slide track 11 and the adjacent end portions of the side members 36, 37, respectively. Support cylinder and piston units 42 and 43 projecting with upwardly and inwardly directed extensions 44 and 45 through slots into the interior of the side members 36 and 37 are mounted for tilting movement about axles 40 and 41, respectively carried on outer ends of the side members 36 and 37. A pair of fluid operated cylinder and piston units 46 and 47 are respectively connected at opposite ends to the extensions 44, 45 and the side members 36, 37, by means of which the support cylinder and piston units 42 and 43 may be tilted relative to the side members 36, 37.

FIG. 3 shows further that the slide 12 with the rail 26 is arranged on the slide track 11, whereas a further slide 48 with a rail 49, a boring bar 51 with its drive 50 is pushed in operating position onto the side member 36. The slides 12 and 48 are movable independent from each other along the slide track 11 and the side members 36 and 37.

As shown in FIGS. 1–3, the caterpillar drive 3 in the operating position of the drill cradle 1 is slightly lifted from the sole 7. In order to arrive at this operating position, the drill cradle is moved first to the desired operating region. By then actuating the cylinder and piston units 38, 39 and 42, 43, the side members 36, 37 and the support cylinder and piston units 42, 43 are brought into the position as shown in FIG. 3. Subsequent thereto either the support cylinder and piston unit 42 or 43 is expanded, so that one side of the caterpillar track is lifted from the sole 7. Subsequent thereto the other support cylinder and piston unit is expanded so that the other side of the caterpillar track is likewise lifted from the sole 7 and so that the slide track 11 and the side members 36, 37 are in exact horizontal position transverse to the moving direction indicated by the arrow 6 in FIG. 2. Thereafter, an additional support cylinder and piston unit 52, connected as shown in FIG. 2 to the center of the rear end of the base frame 4, is extended so that the caterpillar track is completely lifted from the sole 7 and the upper surface of the frame 4 extends in horizontal direction. In this way the slide track 11 and the side members 36, 37 are levelled in all directions and constitute for the further working a definite track of unusual length. It is now possible with one and the same base position of the drill cradle, by moving the slides 12 and 48 with the rails 26 and 49 along the slide track 11 and the side members 36 and 37 to bore a series of desired bore holes one after the other without moving the drill cradle. The same holds true for any anchor setting.

After the work at one place is finished and the drill cradle 1 has to be advanced, the necessary effort is determined by the geological conditions. If the drill cradle is located on even sole or ground in a relatively wide cross-section of an underground mine gallery or at a corresponding plane above ground, it is only necessary to retract the support cylinder and piston units 42, 43 and 52 for such a dimension that the caterpillar track 3 engages again the sole of the mine gallery or the ground and that the aforementioned support units will not hinder the movement of the drill cradle to the next working place. In this case it is not necessary to tilt the support cylinder and piston units 42, 43 relative to the side members 36, 37 nor the side members 36, 37 relative to the slide track 11. The drill cradle 1 can now move to the next working place and subsequent thereto by extension of the support cylinder and piston units 42, 43 and 52 be lifted in the above described manner from the ground and properly levelled, before the work can be renewed.

Figure 4:
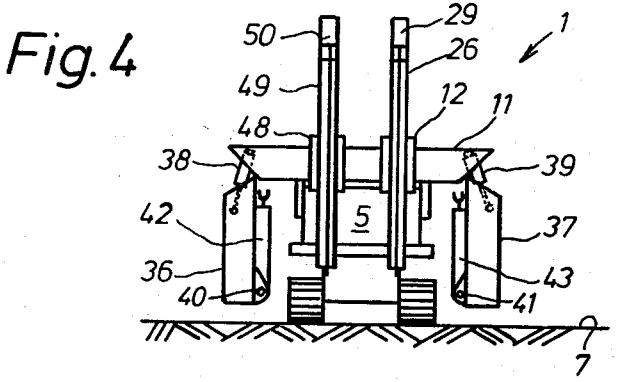
FIG. 4 is a front view of the drill cradle according to FIG. 3 with the side members downwardly tilted relative to the slide track.

If, however, only relatively small cross-sections of the mine gallery are available for the movement of the drill cradle 1, then it is possible, depending on the respective geological conditions, to reduce, before leaving the working place, the outer contour of the drill cradle 1, starting from FIG. 3, in the necessary manner by tilting the support cylinder and piston units 42, 43 and/or the side members 36, 37. The most possible reduction of the outer contour of the drill cradle is shown in FIG. 4 in which at first the support cylinder and piston units 42, 43 by actuating the cylinder and piston units 46, 47 are tilted against the bottom faces of the side members 36, 37 and subsequent thereto the side members 36, 37, by actuating the cylinder and piston units 38 and 39, are tilted downwardly away from the slide track 11. Of course, prior to this tilting of the side members, the slides 12 and 48 are moved onto the slide track 11, as shown in FIG. 4. This is possible without difficulties since parts of the drive element 13 are also connected to the side members 36 and 37.

With the thus maximal reduced outer contour according to FIG. 4, the drill cradle 1 can also move through mine galleries of small widths to the next working place. According to requirements, either both or only one of the side members 36, 37 are at the next working place again tilted in upward direction and lifted from the sole 7 by the corresponding support cylinder and piston units 42, 43. It is therefore not necessary that both side members 36, 37 are simultaneously brought in operating positions.

If the drill cradle has to pass through a mine gallery with relatively low cross-section, then the slide track 11 is tilted rearwardly about its tilting axis 8 by retracting the cylinder and piston units 10, whereby the rails 26 and 49 can be brought to a position in which they extend parallel to the sole 7.

Figure 6:
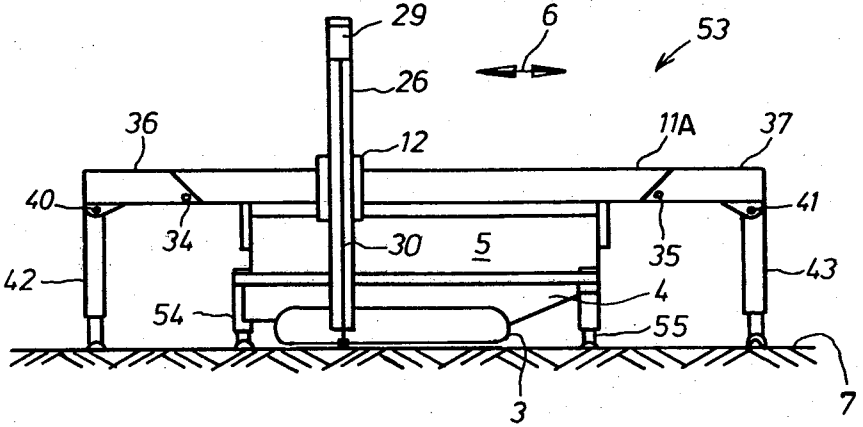
FIG. 6 is a side view of a modified drill cradle with the slide track arranged parallel to the direction of movement of the drill cradle.
Figure 7:
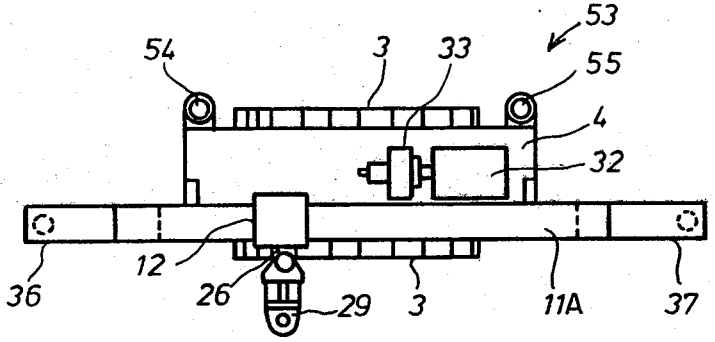
FIG. 7 is a top view of the drill cradle shown in FIG. 6.

FIGS. 6 and 7 illustrate another embodiment of the drill cradle according to the present invention, in which the same parts are indicated with the same reference numerals as used in the preceding figures.

In the drill cradle 53, illustrated in FIGS. 6 and 7, the slide track 11*a* and the side member 36 are arranged parallel to the moving direction 6 so that the work is performed along one longitudinal side of the drill cradle 53. On the longitudinal side of the drill cradle 53, which is opposite the side on which the slide track 11*a* is arranged, additional support cylinder and piston units 54 and 55 are mounted on the base frame 4 for levelling the slide track 11*a* and the side members 36, 37 connected thereto.

Figure 9:
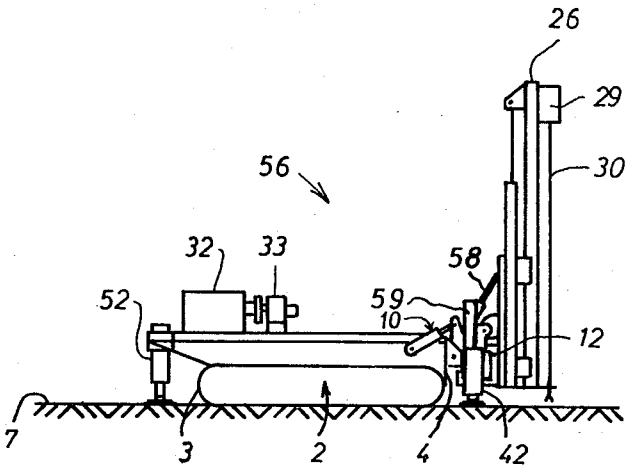
FIG. 9 is a side view of the drill cradle shown in FIG. 8.
Figure 8:
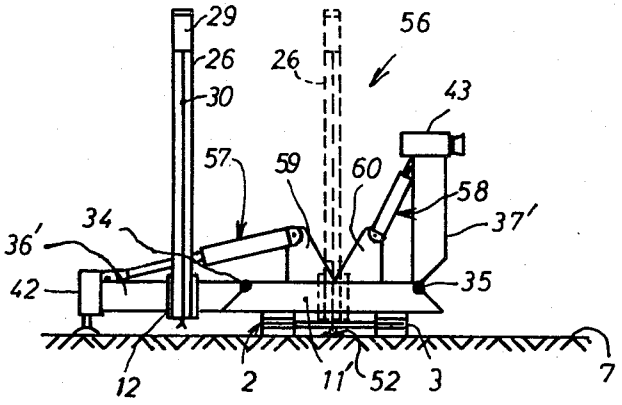
FIG. 8 is a front view of a further modification of the drill cradle shown in FIG. 1 with an especially low arranged slide track.

FIGS. 8 and 9 show a further embodiment of a drill cradle 56, in which the same parts are designated with the same reference numerals as in the preceding embodiments. In this construction the slide track 11' is mounted on the front end of the drill cradle 56 at a relatively small distance from the sole 7. This permits during the boring operation to guide the rail 26 by the slide 12 closely adjacent the place at which transverse forces are transmitted through a boring head on the boring bar 30 to the rail 26.

The side members 36' and 37' are in this case liftable and lowerable by cylinder and piston units 57 and 58 respectively tiltably connected at opposite ends to upright support members 59, 60 and the side members 36', 37'.

It will be understood that each of the elements described above, or two or more together, may also find a useful application in other types of drill cradles differing from the types described above.

While the invention has been illustrated and described as embodied in a drill cradle in which an elongated slide track is carried by carriage means of the drill cradle and in which side members are tiltably connected to opposite ends of the slide track to extend the latter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drill cradle comprising carriage means; an elongated slide track carried by said carriage means substantially parallel to the sole of a mine gallery in which the drill cradle may be used; at least one slide supported on said slide track movable therealong; an elongated rail mounted on said slide movable in axial direction and turnable about an axis; a boring bar and a drive therefor mounted on said rail; two side members respectively connected to opposite ends of said slide track for extending the latter in longitudinal direction, each of said side members having at least in a guide region for said at least one slide the same cross-section as such slide track and each of said side members being pivotally connected at one end to a respective one of said opposite ends of said slide track and having opposite said connected ends a free end; means connected to said slide track and the respective side member for adjusting the position of each side member relative to said slide track; two supporting cylinder and piston units, each pivotally connected at one end to the free end of a respective side member, abutting when the respective side member forms an extension of said slide track, with the other end against the sole of the mine gallery; and means interconnected between each side member and the supporting cylinder and piston unit connected thereto for changing the position of the supporting cylinder and piston unit relative to the respective side member.

2. A drill cradle as defined in claim 1, wherein each of said position changing means comprises a fluid operated cylinder and piston unit pivotally connected at opposite ends to the respective side member and the supporting cylinder and piston unit connected thereto.

3. A drill cradle as defined in claim 1, wherein said slide track and said side members connected thereto are mounted on said carriage means tiltable about an axis extending parallel to the longitudinal direction of said slide track and including means connected to said carriage means and said slide track for tilting the latter about said axis.

4. A drill cradle as defined in claim 3, wherein said tilting means comprises at least one fluid operated cylinder and piston unit pivotally connected at opposite ends to said carriage means and said slide track.

5. A drill cradle as defined in claim 3, wherein said slide track extends normal to the direction of movement of said carriage means.

6. A drill cradle as defined in claim 1, wherein said slide track extends in a direction parallel to the direction of movement of said carriage means.

7. A drill cradle as defined in claim 1, and including turning means for turning said rail about an axis, said turning means being carried by said slide tiltable about a tilting axis extending parallel to the longitudinal direction of said slide track and including a fluid operated cylinder and piston unit pivotally connected at opposite ends to said slide and said turning means.

8. A drill cradle as defined in claim 7, wherein said turning means has a drive shaft operatively connected to said rail for carrying the latter and extending at an angle of 90° to said tilting axis of the turning means for turning said rail through an angle of 360°.

9. A drill cradle as defined in claim 8, and including an advancing cylinder extending normal and being fixed to said drive shaft of said turning means and having a piston rod pivotally connected at its outer end to said rail and at least two guide members carried spaced from each other by said advancing cylinder and engaging said rail and guiding the latter movable in longitudinal direction.

* * * * *